US007140455B2

(12) United States Patent
Walter et al.

(10) Patent No.: US 7,140,455 B2
(45) Date of Patent: Nov. 28, 2006

(54) VALVE METHOD FOR DRILLING WITH CASING USING PRESSURIZED DRILLING FLUID

(75) Inventors: Bruno H. Walter, Vancouver (CA); Robert M. Tessari, Houston, TX (US); Per G. Angman, Calgary (CA)

(73) Assignee: Tesco Corporation, Calgary (CA)

( * ) Notice: Subject to any disclaimer, the term of this patent is extended or adjusted under 35 U.S.C. 154(b) by 255 days.

(21) Appl. No.: 10/492,559

(22) PCT Filed: Jan. 30, 2004

(86) PCT No.: PCT/CA2004/000126

§ 371 (c)(1),
(2), (4) Date: Aug. 12, 2004

(87) PCT Pub. No.: WO2004/067903

PCT Pub. Date: Aug. 12, 2004

(65) Prior Publication Data

US 2006/0037784 A1 Feb. 23, 2006

(30) Foreign Application Priority Data

Jan. 30, 2003 (CA) ..... 2417746

(51) Int. Cl.
*E21B 21/10* (2006.01)
*E21B 19/00* (2006.01)

(52) U.S. Cl. ..... 175/218; 175/318; 175/71; 166/87.1; 166/77.51

(58) Field of Classification Search ..... 175/218, 175/57, 71, 257, 162, 318, 317; 166/80.1, 166/86.1, 86.2, 87.1, 77.52, 77.51, 77.1, 166/382

See application file for complete search history.

(56) References Cited

U.S. PATENT DOCUMENTS 4,120,368 A 10/1978 Johansson
4,315,553 A 2/1982 Stallings
4,936,397 A 6/1990 McDonald et al.
4,949,796 A 8/1990 Williams
4,958,689 A 9/1990 Lee
5,048,620 A 9/1991 Maher
5,101,913 A 4/1992 Stockley et al.
5,584,343 A * 12/1996 Coone ..... 166/387
5,735,348 A * 4/1998 Hawkins, III ..... 166/285
5,890,549 A 4/1999 Sprehe
5,971,079 A 10/1999 Mullins
6,119,772 A 9/2000 Pruet (Continued)

*Primary Examiner*—Kenneth Thompson
(74) *Attorney, Agent, or Firm*—Bennett Jones LLP

(57) ABSTRACT

A valve (30), a drill string valve assembly (10) and a method of drilling using compressed fluid as a drill drilling fluid are described. The valve and valve assembly (10) may be used in order to prevent escape of compressed fluid during the time that a connection is being made into the drill string. The valve (10) can be insertable into a drill string inner diameter to seal against fluid passage past the body except through the valve (30) and can be selected to maintain fluid pressure in the drill string when the upper end of the drill string is open to atmosphere. The valve can also be capable of being releasably engaged to a drive mechanism, such as a top drive (40) which is handling the drill string (12) to be slidably moved within the drill string, as driven by the drive mechanism, but releasable from the drive mechanism, when the drive mechanism is removed from the drill string.

38 Claims, 11 Drawing Sheets

U.S. PATENT DOCUMENTS 6,209,683 B1 4/2001 Hosie

2002/0096334 A1* 7/2002 LaFleur ..... 166/334.4

* cited by examiner

VALVE METHOD FOR DRILLING WITH CASING USING PRESSURIZED DRILLING FLUID

FIELD

This invention is directed to drilling with casing when using a pressurized fluid as a drilling fluid.

BACKGROUND

When drilling with casing, the volume of drilling fluid in the drill string is large. If a compressible fluid such as, for example, air is used as a drilling fluid, significant handling problems can occur with this large volume of fluid under pressure.

When drilling, compressed gas has to be introduced through the ID of the top drive that is connected to the top end of the casing drill string. When the top drive is required to pick up a next joint of casing, the top drive is removed from the casing string ID. During that time if the drill string is left open, compressed gas can exit under considerable pressure, which would prevent a connection from being made until the pressure in the casing drill string is equalized with the atmospheric pressure. Time required for the equalization of pressure would be long and at the same time energy introduced, to compress the gas in the first place, would be lost.

When the connection of the next joint of casing was finally made, the gas in the whole length of the drill string would have to be compressed again prior to resuming the drilling operation.

As such, for drilling with casing with compressed gas as the drilling fluid to be economically feasible, the volume of the compressed gas has to be retained in the drill string throughout the drilling process, even when the top drive is disconnected in order to attach new joint of the casing string.

SUMMARY OF THE INVENTION

A valve, a drill string valve assembly and a method of drilling using compressed fluid as a drilling fluid has been invented. The valve and valve assembly may be used in order to prevent escape of compressed fluid during the time that a connection is being made into the drill string.

In accordance with one broad aspect of the present invention there is provided a method for drilling with a compressible drilling fluid, the method comprising: providing a drill string having an inner wall, an inner diameter and an upper end, positioning a valve into the drill string inner diameter to seal against fluid passage therepast except through the valve and the valve being selected to maintain fluid pressure in the drill string when the upper end of the drill string is open to atmosphere; repositioning the valve adjacent the upper end of the drill string each time a joint of pipe is added to the drill string while maintaining drilling fluid pressure inside the drill string.

In accordance with another broad aspect of the present invention, there is provided a valve for use with a drill string axial and rotational drive mechanism in a drilling operation, the valve being insertable into a drill string inner diameter to seal against fluid passage past the body except through the valve and selected to maintain fluid pressure in the drill string when the upper end of the drill string is open to atmosphere and capable of being releasably engaged to the drive mechanism to be slidably moved within the drill string, as driven by the drive mechanism, but releasable from the drive mechanism, when the drive mechanism is removed from the drill string.

In accordance with another broad aspect, there is provided a method for manipulating a drill string when using a drill string axial and rotational drive mechanism and a compressed fluid as the drilling fluid, the drill string having an inner wall and an upper end, and the method comprising: providing a valve insertable into a drill string inner diameter to seal against fluid passage therepast except through the valve and selected to maintain fluid pressure in the drill string when the upper end of the drill string is open to atmosphere and capable of being releasably engaged to the drive mechanism to be slidably moved within the drill string, as driven by the drive mechanism, but releasable from the drive mechanism, when the drive mechanism is removed from the drill string; positioning the valve in the drill string inner diameter adjacent an upper end thereof; engaging the valve with the drive mechanism to move therewith to remain adjacent the upper end of the drill string as pipe connections are made thereto; and injecting fluid as the drilling fluid to the drill string through the valve.

The drill string can be used to drill a borehole with the fluid as the drilling fluid and the valve can seal the compressed fluid within the drill string such that the fluid pressure need not be lost each time the upper end of the drill string is opened to atmosphere, as by removal of the drive mechanism therefrom. The drill string can be a casing or liner string and the manipulation can be during a drilling operation wherein casing, or another liner, is used as the drill string. The valve can include a one-way valve wherein fluid can flow through the valve into the lower part of the drill string but reverse flow is prevented. The drill string may initially be a single joint of drill pipe but may be built up by connection of further joints thereto.

The drill string axial and rotational drive mechanism can be any mechanism that supports the axial load and applies rotational drive to the upper end of the drill string. Such mechanisms can include, for example, a top drive, a top drive with a casing drive system attached, a power sub, etc.

In one embodiment, the drive mechanism may include an extension extending therefrom a distance such that when the drive mechanism engages to a pipe joint to be attached to the drill string, the extension extends through the pipe joint and out from the end of the pipe joint such that the extension engages the valve when the drive mechanism brings the drill string pipe joint over the drill string in which the valve is positioned at the upper end thereof. In one embodiment, a valve-retaining clamp is provided for securing over the upper end of the drill sting to retain the valve in the drill string when the drive mechanism is removed therefrom. The valve-retaining clamp can act as a guide to facilitate insertion of the extension into the upper end of the drill string.

There is also provided, a valve device for sealing a pressurized fluid within a drill string during drilling using a drill string axial and rotational drive mechanism and using a compressed fluid as the drilling fluid, the drill string having an inner wall and the valve device comprising: a valve body having a bore therethrough from its upper end to its lower end; a seal about the valve body, to seal between the valve body and the drill string inner wall but permitting the valve to be positionable in and slidable through the drill string; a one-way valve in the bore permitting fluid flow through the bore from the upper end to the lower end but sealing against reverse flow therethrough: a portion for releasable engagement with the drive mechanism such that the valve is drivable by the drive mechanism through an upper portion of the drill string, but releasable therefrom to remain in the drill string when the drive mechanism is removed therefrom.

Also in accordance with the present invention, there is a valve assembly for sealing a pressurized fluid within a drill string during drilling using a drill string axial and rotational drive mechanism and a compressed fluid as the drilling fluid, the drill string having an inner wall and an upper end and the valve assembly comprising: a valve body having a bore therethrough from its upper end to its lower end; a seal about the valve body, to seal between the valve body and the drill string inner wall but permitting the valve to be positionable in and slidable through the drill string; a one-way valve in the bore permitting fluid flow through the bore from the upper end to the lower end but sealing against reverse flow therethrough, a portion for releasable engagement with the drive mechanism such that the valve is drivable by the drive mechanism through an upper portion of the drill string, but releasable therefrom to remain in the drill string when the drive mechanism is removed therefrom; and a valve-retaining clamp for securing over the upper end of the drill sting to retain the valve in the drill string when the drive mechanism is removed therefrom.

The one way valve can be, for example, a ball check valve, a flapper valve, etc. that is biased, as by a spring, into a closed position. The seal about the valve body can be for example a packer seal element that will seal passage of compressed fluid between the ID of the casing and the outside of the valve body.

The valve body can include a landing portion, for example, including a bearing ring such as a brass ring, for accepting therein a portion of or an extension of the drive mechanism and releasably locking thereto such that the valve is driven by the drive mechanism through an upper portion of the casing string. The landing portion can include a seal to provide sealing engagement between the drive mechanism and the valve body so that fluid can be injected from the drive mechanism into the bore of the valve body to pass through the one-way valve.

An extension can be attached to the drive mechanism for engaging the valve body. An extension, such as a spear, can be selected to extend down from the drive mechanism a length longer than a joint of casing to extend out from a lower end of the joint of casing when the drive mechanism is threaded into that joint's upper end. The bottom end of the extension may be formed into a stinger that can interact with the bore geometry of the valve body. The extension can be formed as a conduit extending from and in communication with the drilling fluid conduit of the drive mechanism such that drilling fluid can be passed through the drive mechanism and into the extension for injection through the bore of the valve and, thereby into the drill string.

The valve device can include a releasable drill string engaging means that secures the valve body to the inner wall of the drill string such that it does not drop by gravity through the drill string, but remains in the upper portion of the drill string. In one embodiment the drill string is a string of well bore casing and the releasable drill string engaging means includes a plurality of collet fingers that will engage against the pin engaging face of the torque ring or the face of the casing pin end. The collet fingers can be forced inwardly to move past the stepped surface and move through the drill string, as driven by the drive mechanism. However, the fingers may be biased to spring back out and engage against the pin or torque ring end face, when the drive mechanism moves the valve body up to the upper end of the drill string.

In one embodiment, including the drive mechanism extension with the stinger end, a valve body with a landing portion including a bronze washer and collet fingers acting as releasable drill string engaging means, the bottom end of the stinger can be formed to abut against the bronze axial bearing washer forming the landing portion in the valve body and the O.D. of the stinger bottom end may engage seals to provide a seal between the O.D. of the stinger and the ID of the landing portion valve body to prevent the flow of compressed fluid between the parts. The stinger tip may also include a cylindrical outside surface that may bear against the internal edges of the collet fingers to ensure that the outside finger edges are solidly hooked on the torque ring or the pin end of the casing as the stinger is being inserted into the valve device. The stinger tip may also include an annular groove into which the fingers can collapse once the stinger is fully inserted into the landing portion, so that the fingers can be driven out of engagement with the pin end by the drive mechanism. The stinger tip/fingers may be further formed to permit releasably engagement between the valve body and the drive mechanism extension, when the fingers collapse and are moved past the end face. In particular, when the stinger is fully inserted into the landing portion, the drive mechanism can push the valve device down and the outside lugs on the fingers that were interfering with the torque ring or the ID of the casing can be forced to collapse inward into the groove that is provided on the OD of the extension so that the valve is carried on the drive mechanism extension.

In use, the valve assembly of the embodiment noted hereinbefore can be used to retain the pressure in a drill string, wherein compressed fluid is used as a drilling fluid. In such an embodiment, the valve is positioned in a drill string adjacent the upper end thereof with the collet fingers engaged against the torque ring or pin end face. The drive mechanism is used to engage drill pipe joints and bring them for connection into the drill string in which the valve device is engaged. As a drill pipe joint is brought into alignment with the upper end of the drill string, the extension may move into the landing portion of the valve body and eventually engage against the bearing ring.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIGS. 1A–1L are schematic axial sectional views along a drill string illustrating use of a valve device of the present invention.

DETAILED DESCRIPTION OF VARIOUS EMBODIMENTS

Figures 1A, 1B, 1C, 1D, 1E:
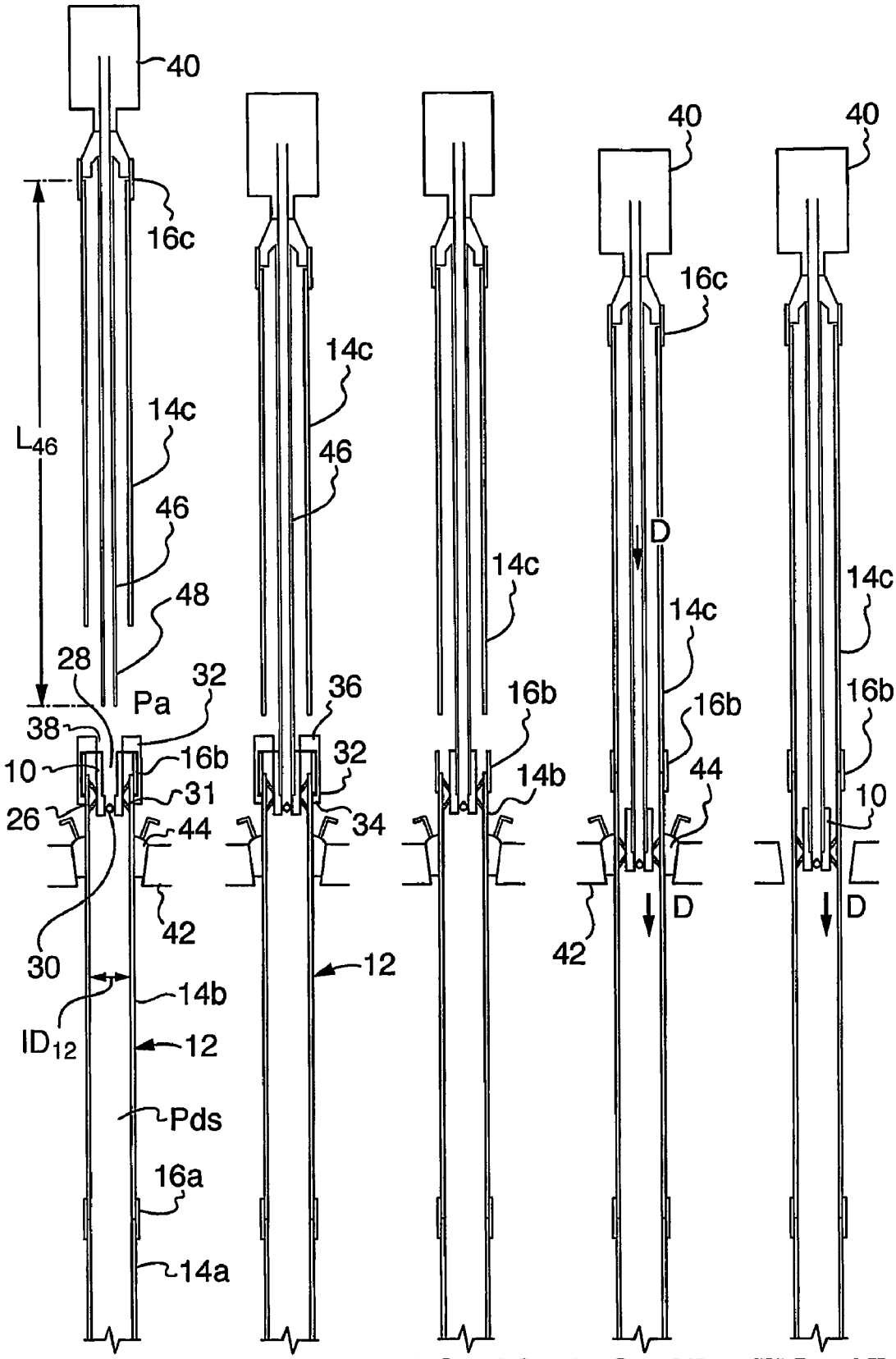

Referring to FIG. 1A, a valve device 10 according to the present invention is shown inserted into a drill string 12 inner diameter $ID_{12}$. In the illustration, drill string 12 is being used for drilling with casing with compressed air as the drilling fluid and, as such, during drilling the pressure within drill string Pds is much greater than the atmospheric air pressure Pa. A top drive, indicated generally at 40, may be used to engage the drill string during drilling and to bring drill string tubulars for connection to the drill string. Of course, top drive 40 can be any drive mechanism that supports the axial load and applies rotational power to the top of the drill string. For example, top drive 40 could be replaced by a drive sub or a top drive with a casing clamp or casing drive assembly connected thereto. These options are encompassed herein by the term top drive.

Valve device 10 is positioned adjacent an upper end of the drill string and acts to seal against fluid flow out of the drill string inner diameter. If valve device 10 was not present in drill string 12, air pressure Pds would be lost through the string's open upper end, for example, each time the top drive is removed, as shown in FIG. 1A. The top drive is removed from the upper end each time another drill string tubular is engaged for connection into the drill string.

In the illustrated embodiment, drill string 12 is formed of casing and includes a plurality of casing joints 14*a*, 14*b* connected by couplings 16*a*, 16*b*. A drill bit (not shown) is installed on a lower end of the drill string.

Valve device 10 includes a valve body 26 having a bore 28 extending from its upper end to its lower end and in the bore a one-way valve 30, which prevents fluid flow through the bore except from the upper end to the lower end. Valve device 10 further includes a seal 31 disposed about the valve body to prevent fluid passage about the annulus between valve body 26 and the drill string inner wall.

Because pressure Pds is greater than Pa, a valve-retaining clamp 32 is secured over the open upper end of the drill string to prevent valve device 10 from be expelled from the drill string by the pressure differential. Valve-retaining clamp 32 includes a return 34 at its lower end for engaging under connection 16*b* and a return 36 at its upper end for extending out over the open end of coupling 16*b*. Return 36 is selected to prevent passage therethrough of valve device 10 but return 36 may define a bore 38 through the upper end of the clamp to provide access to the drill string inner diameter $ID_{12}$. The purpose of bore 38 will become apparent hereinbelow.

FIGS. 1A to 1L illustrate schematically use of a valve assembly according to the present invention and, therefore, a method according to the present invention.

Valve device 10 is positioned in drill string 12 and can be used, for example, with top drive 40. The top drive is useful for manipulating the drill string by supporting and rotating the drill string to drill a borehole and by connecting further casing joints 14*c* to those already connected into the drill string to increase the length of the drill string. In particular, a casing joint 14*c* and a coupling 16*c* installed on it is engaged by the top drive. The casing joint 14*c* is then brought, as by hoisting the top drive, over the drill string 12, which is held in the drill floor 42, for example by slips 44, and casing joint 14*c* is aligned with a threaded coupling 16*b* on the upper end of the drill string.

In the present method, wherein valve device 10 is positioned in the drill string, the valve device may remain in the drill string to prevent the drill string from loosing pressure Pds. It is desirable that the valve device remain adjacent the upper end of the drill string so that substantially all of the drill string remains pressurized and the valve is accessible for manipulation. As such, valve device 10 is releasably engageable to top drive 40, and in particular, to an extension conduit 46 directly or indirectly secured to, and extending down from, the top drive. Extension conduit 46 extends out from top drive 40 a length $L_{46}$ greater than the combined length of the casing joint and the connected coupling with which it is intended to be used, which in this case is shown as casing joint 14*c* and it's connected coupling 16*c*. As such, when a casing joint and coupling are connected to the top drive, the extension conduit extends through the casing joint and coupling and a bottom end portion 48 of the extension extends out beyond the lower end of the casing joint. An extension conduit may sometimes be called a stinger, which is an oilfield term used to describe a long element that is stabbed into a tubular element. While an extension conduit is shown, it is to be understood that the extension need not be formed as a conduit to convey fluid, if that is not desired.

When top drive is brought over the drill string connected in drill floor 42, for example to bring casing joint 14*c* over into engagement with the drill string (FIGS. 1A and 1B) bottom end portion 48 may be extended through bore 38 in the valve-retaining clamp to engage the valve device. Bore 38 in the upper return of clamp 32 may, therefore, be sized to permit passage therethrough of the extension's bottom end portion 48.

In this position, extension 46 can engage and hold the valve device in the drill string so that valve-retaining clamp 32 can be removed, FIG. 1C. In particular, clamp 32 may be removed as it is no longer needed to retain the valve device in the drill string, that action being accomplished by the extension. Removal of the valve-retaining clamp 32 also opens coupling 16*b* for threaded insertion of casing joint 14*c*, FIG. 1D. Once the casing joint is threaded to coupling 16*b*, the weight of the drill string, now including casing joint

14*c*, is supported on top drive 40 such that slips 44 can be removed, FIG. 1E, and the drill string can be driven down to resume drilling, FIG. 1F. While the illustration appears to show casing joint 14*c* and the entire string hung off of a threaded connection to top drive, it is to be understood that a casing clamp, casing drive assembly or other means can be used to support casing joint 14*c*, etc.

During drilling, drilling fluid is injected, arrows D, through top drive 40, extension conduit 46, bore 28 and valve 30 into the drill string inner diameter. Valve 30 permits flow of the drilling fluid in that direction. During drilling, valve device 10 may be engaged on, to move with, the bottom end portion 48 of the extension conduit.

Figures 1G, 1H, 1I, 1J:
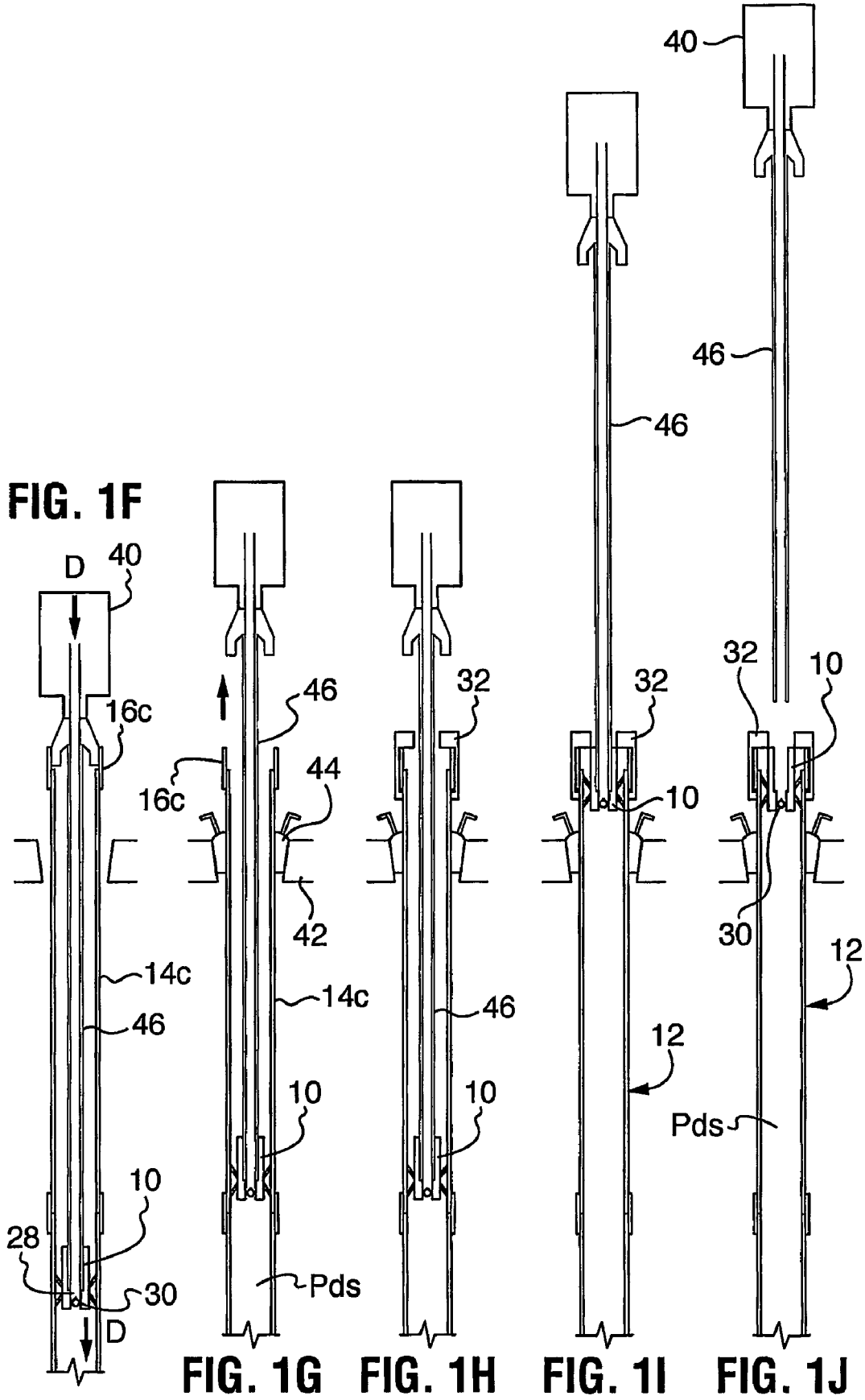

When coupling 16*c* is in a position such that another casing joint must be added, drilling is stopped and top drive 40 is disengaged from casing joint 14*c*, FIG. 1G, to engage a further casing joint. Prior to removal of the top drive, the drill string must again be supported, for example by slips 44, in drill floor 42. As top drive 40 is removed, extension conduit 46 is withdrawn from casing joint 14*c* and, since valve device 10 is connected thereto, it is drawn with the extension up into casing joint 14*c* toward coupling 16*c*. With reference to FIG. 1H, in preparation for removal of top drive 40 and its connected extension 46 from the drill string, valve-retaining clamp 32 is again secured over the open upper end of the drill string, which is now in the illustrated embodiment defined by coupling 16*c*.

Figure 11:
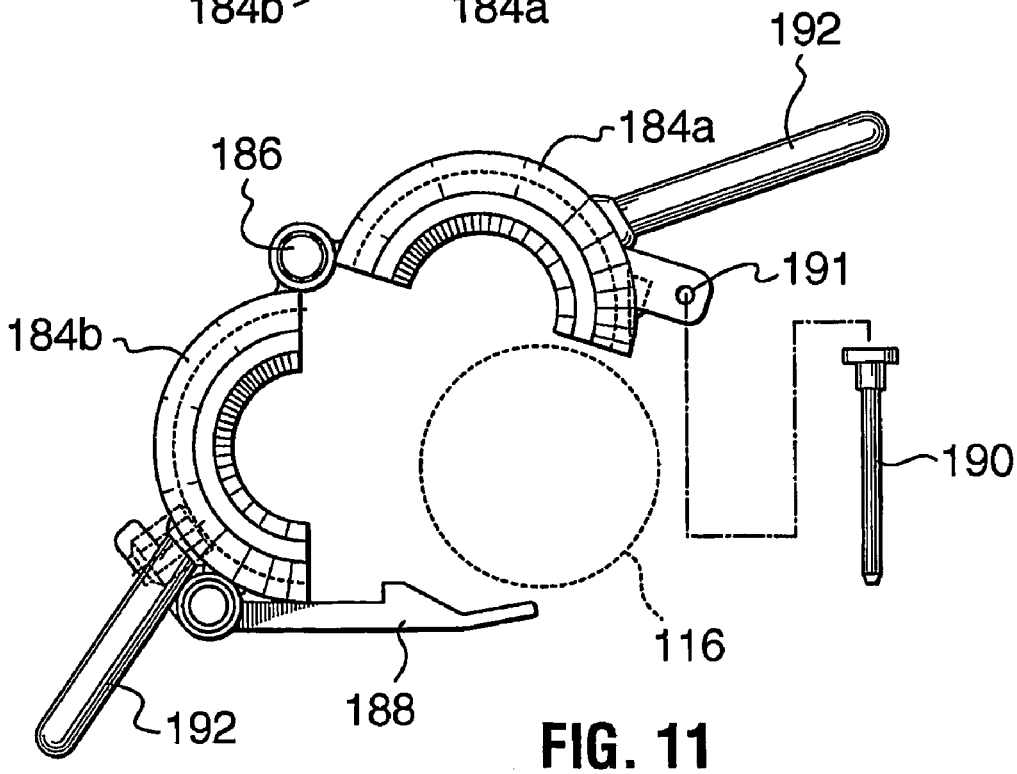
FIG. 11 is an end view of a valve-retaining clamp, taken from a view similar to FIG. 9 but showing the clamp in an open configuration.

When valve device 10 is drawn up and reaches the open upper end of the drill string, it is released from engagement with the extension conduit and remains in the drill string, FIG. 11. Release can be achieved by various means, such as by abutment against clamp 32, which forces the engagement to be released or by release of catches, or engagement devices acting between the valve device and the extension conduit, or a combination thereof.

In any event, with reference to FIG. 1J, the valve device remains in the drill string to maintain pressure Pds by action of one way valve 30 and seal 31 and the top drive is free to move to pick up another casing joint. The drilling process and manipulation of the drill string will continue as shown in FIGS. 1A to 1J.

Figure 1K:
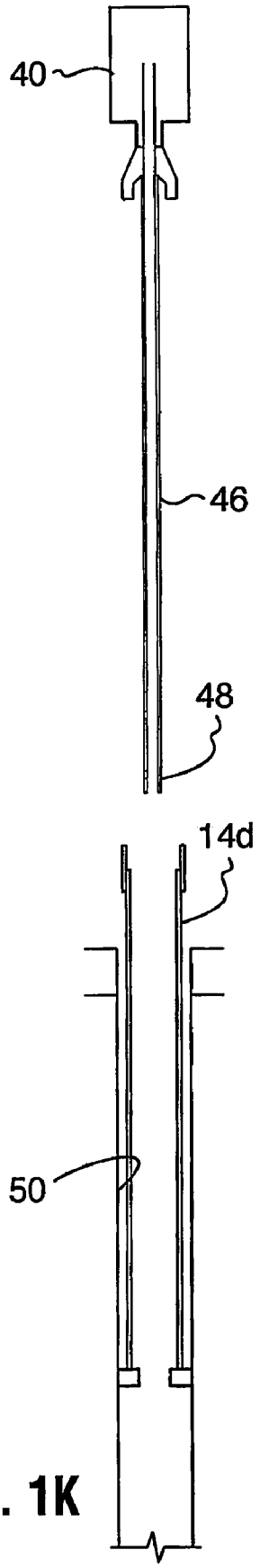
Figure 1L:
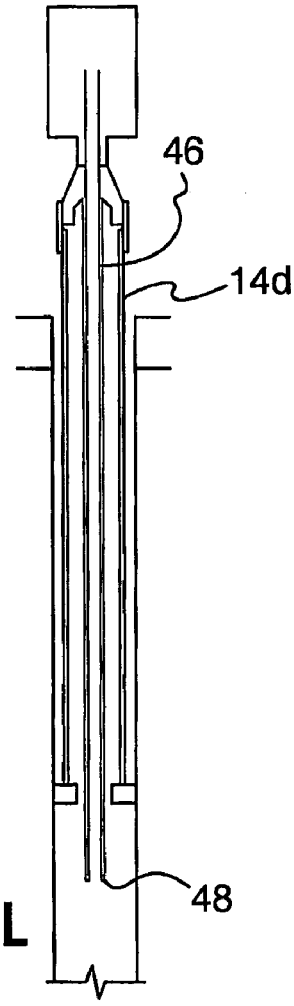
Figure 2A:
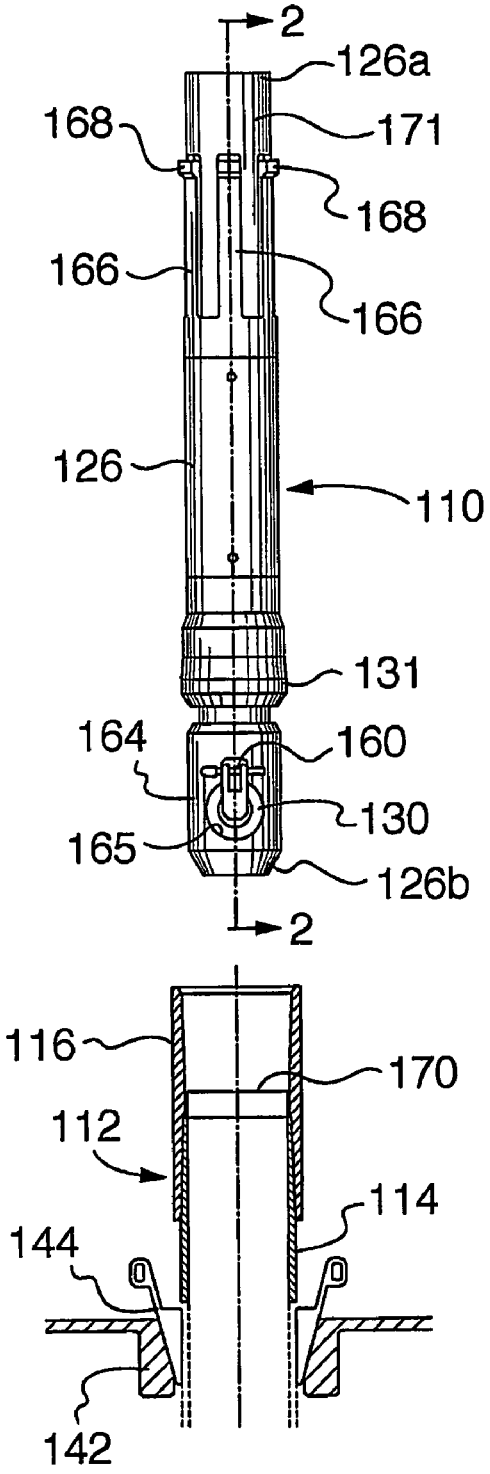
FIG. 2A is an axial sectional view of an upper end of a casing string positioned in a drill floor with slips in place and a valve device, shown in side elevation, aligned for insertion into the string.
Figure 2B:
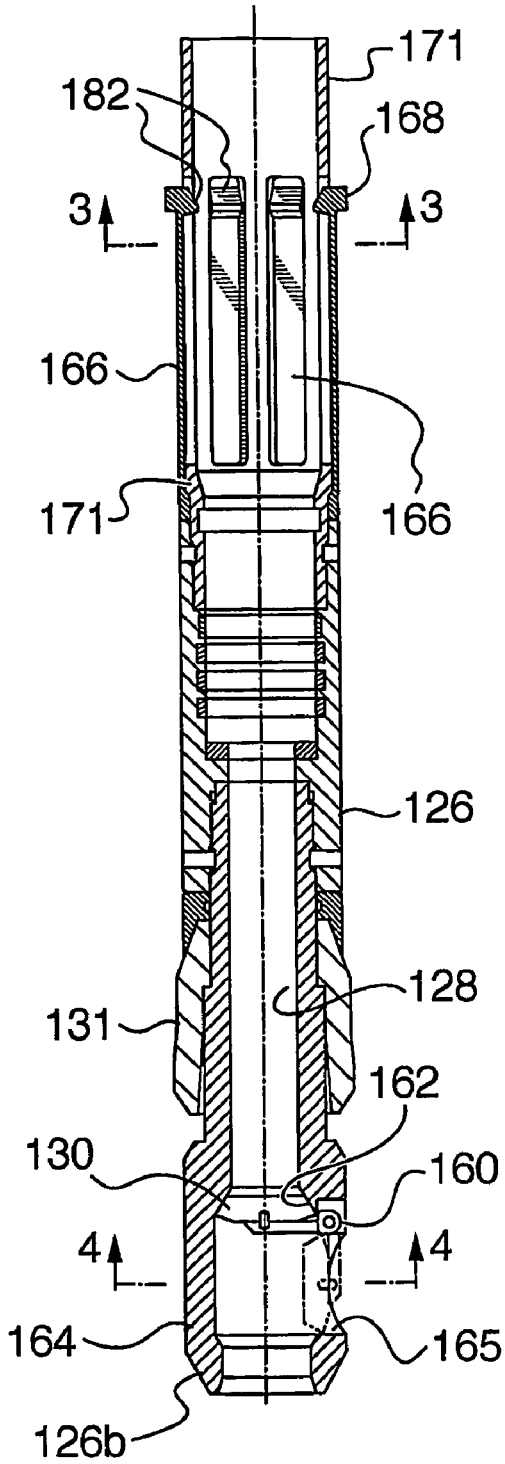
FIG. 2B is an axial sectional view through the valve device, along line 2—2, as shown in FIG. 2A.
Figure 3:
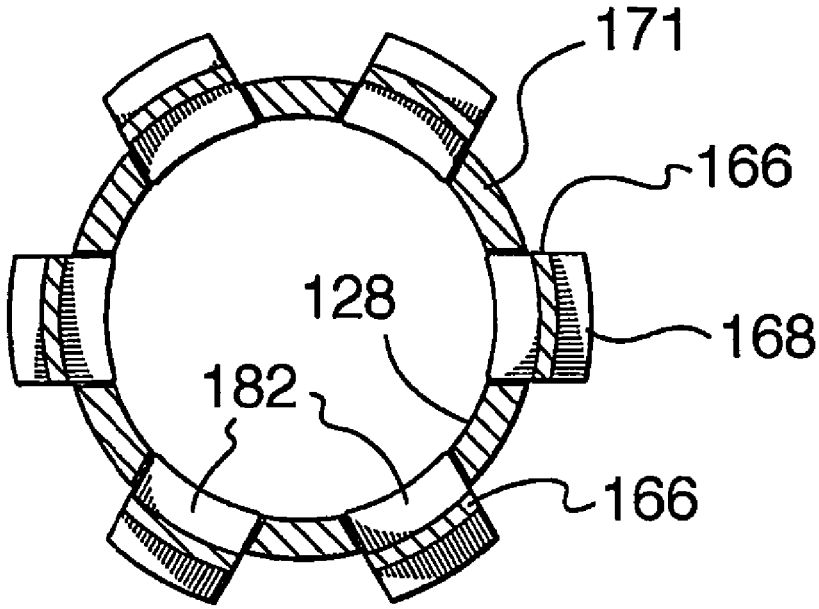
FIG. 3 is a transverse sectional view through the collet section taken along line 3—3 in FIG. 2B.
Figure 4:
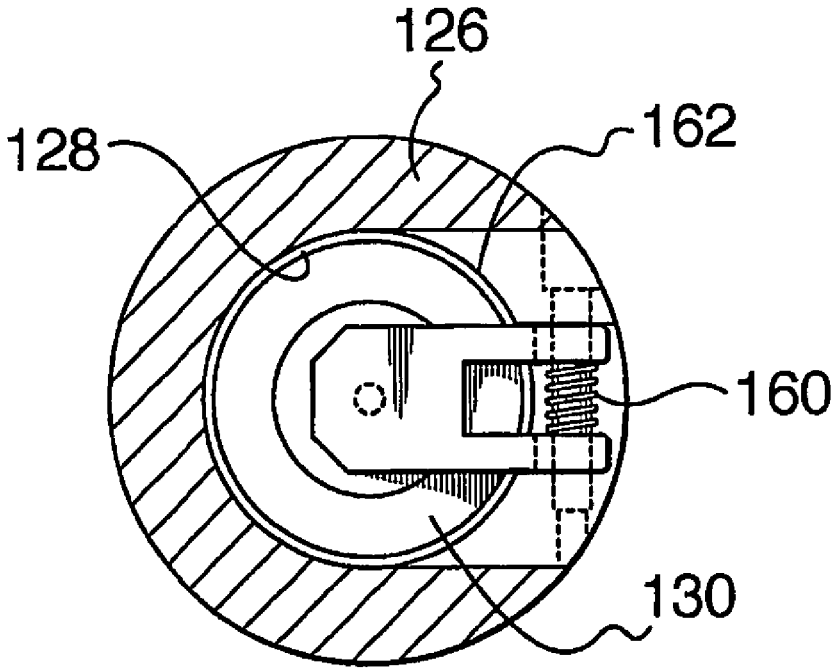
FIG. 4 is a transverse sectional view through the flapper valve section taken along line 4—4 in FIG. 2B.

Referring to FIGS. 1K and 1L, it is noted that in drilling with casing the next casing joint 14*d* may be retained in what is commonly referred to as a mouse hole 50. It will be apparent that the mouse hole may have to be modified to permit passage therein of the extension conduit, as for example by forming an opening through the bottom end 52 thereof so that extension conduit 46 can extend fully through the casing joint when the top drive is moved in to engage the casing joint.

Referring to FIGS. 2A to 5, another valve device 110 is shown according to the present invention. Valve device 110 is shown aligned for insertion into an upper open end of a drill string 112, including a casing joint 114 and threaded thereto a coupling 116, supported in a drill floor 142 by slips 144.

Valve device 110 includes a valve body 126 having a bore 128 extending from its upper end 126*a* to its lower end 126*b* and a one-way flapper valve 130 therein which prevents fluid flow through the bore except from the upper end to the lower end. In the illustrated embodiment, the valve body is formed in sections that are threaded, secured or fastened together to facilitate manufacture. Of course fewer or more sections can be used, as desired.

Valve device 110 further includes a seal 131 disposed thereabout to prevent fluid passage upwardly about the annulus between valve body 126 and the drill string inner diameter, when the valve device is installed in the drill string with end 126*b* directed downwardly.

Flapper valve 130 is pivotally connected to the body and biased by a spring 160 to seal against seat 162 to prevent flow upwardly from lower end 126*b* to upper end 126*a* but can be opened by flow downwardly through the bore, as by injection of drilling fluid. In the illustrated embodiment, an extension 164 is provided on the opening side of seat 162 which extends below the flapper valve when it is in the open position. Extension 164 spaces the turbulence from the flapper valve to extend its useful life by reducing vibration effects on the flapper, the turbulence being created by the fluid flow stepping from the valve diameter to the drill string inner diameter. To permit the flapper valve to be out of the way of the high velocity drilling fluid, as it is pumped through the bore, extension 164 may include a recess 165 (configured as an opening in the illustrated embodiment) into which flapper valve 130 can fit when in the open position.

Valve device 110 includes an engaging means which holds the device in the upper end of the drill string except when it is in engagement with and driven by the top drive. In particular, in the illustrated embodiment the engaging means includes a plurality of collet fingers 166 integral with or attached to (as shown) the valve body. Collet fingers 166 are biased outwardly and include radially outwardly extending lugs 168 configured to engage against a stepped portion 170, such as the pin end face or the torque ring end face, of the drill string inner wall. The outward bias of collet fingers 166 and the configuration of the radially outwardly extending lugs 168 are selected to hold the valve device on the stepped portion preventing it from dropping down the drill string by gravity. However, lugs 168 include ramped or radiused surfaces such that this engagement can be overcome by force applied axially driving the collets against the stepped portion, which causes them to collapse inwardly. This force can be applied through the top drive, as will be described hereinbelow. Collet fingers 166 are formed to also have inwardly extending lugs 182, as will be more fully described hereinbelow, for engagement to the top drive. A tube 171 extends about and beyond fingers 166 so that they are protected, to some extent, and to ease passage of internal members past the fingers without catching on them.

Figure 6:
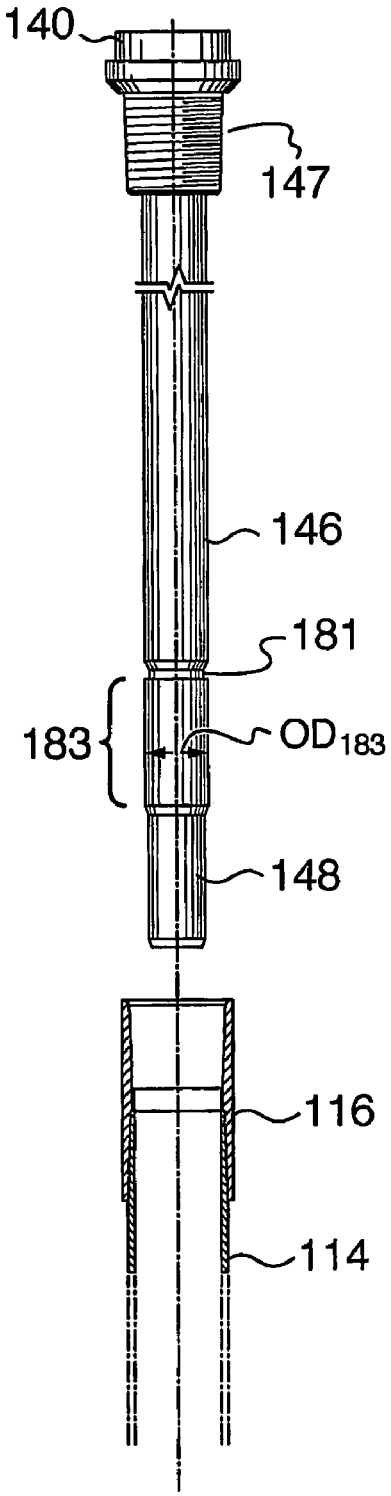
FIG. 6 is an axial sectional view of a casing joint with the casing coupling on the top end and a side elevation of a top drive extension with a stinger tip secured to the bottom end of the top drive member.
Figure 7:
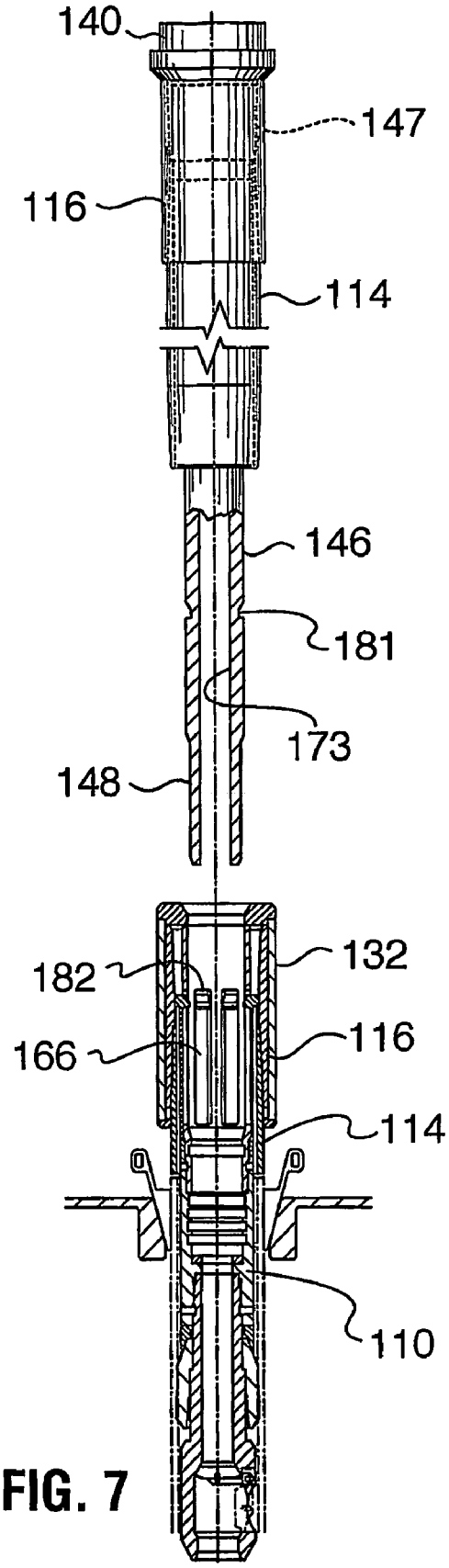
FIG. 7 is an axial sectional view through a stinger tip and through a valve device, which is inserted into the top end of a casing string secured by slips to the drilling floor and showing a valve-retaining clamp installed on the upper end of the drill string.
Figure 8:
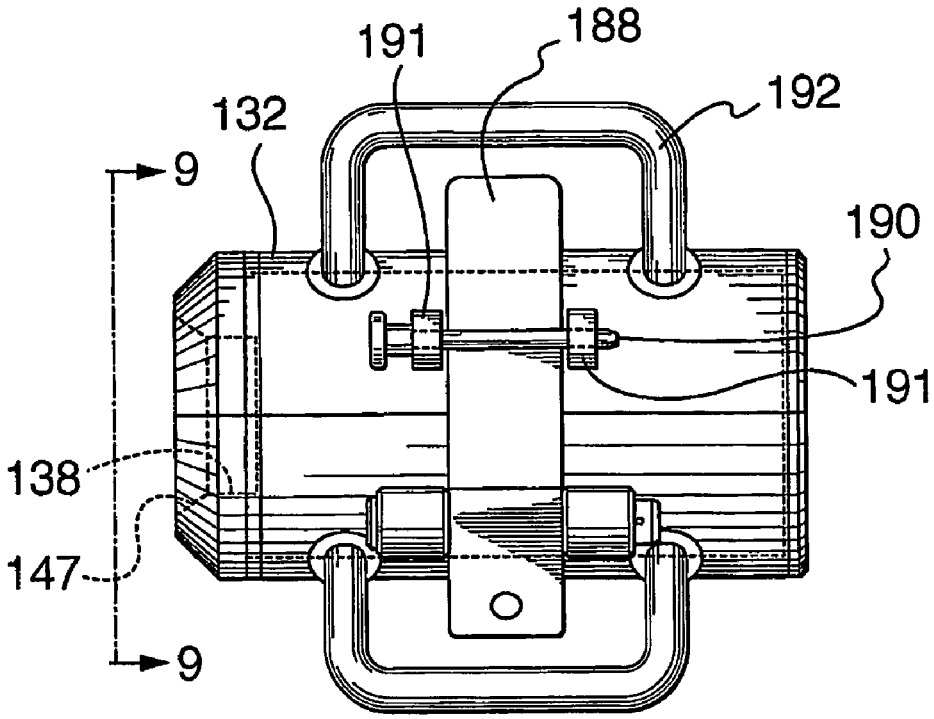
FIG. 8 is a side elevation of a locked valve-retaining clamp.
Figure 9:
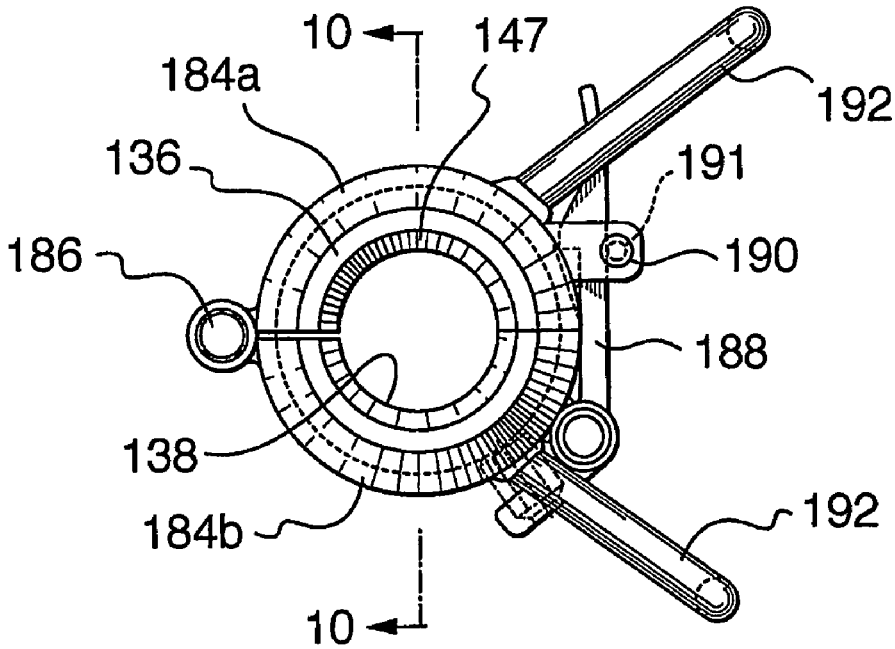
FIG. 9 is an end view, as shown by lines 9—9 on FIG. 8.
Figure 10:
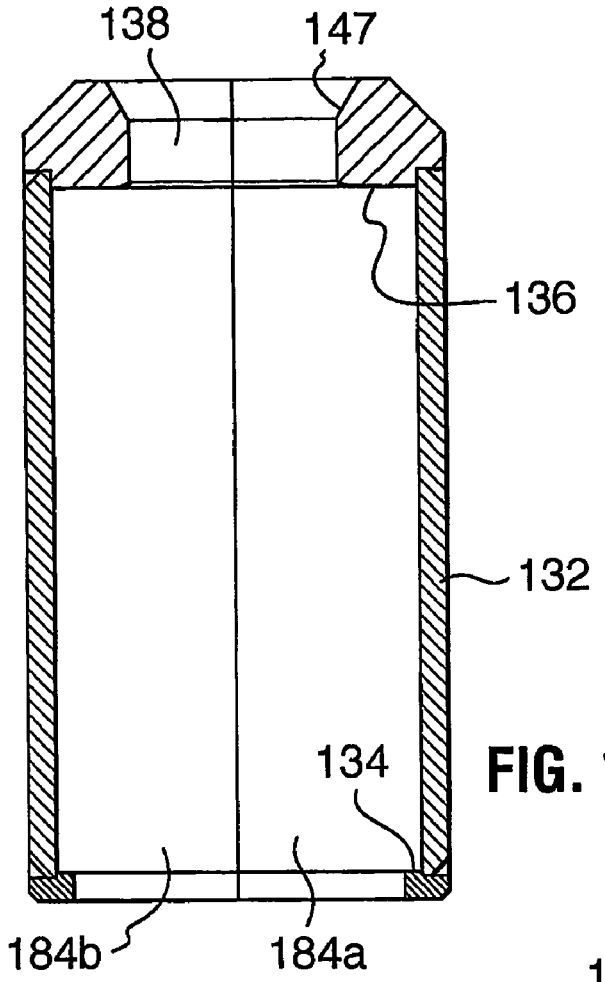
FIG. 10 is an axial sectional view through the valve-retaining clamp taken along lines 10—10 in FIG. 9.

With reference also to FIGS. 6 and 7, in the illustrated embodiment, the valve device 110 can be engaged for movement through the drill string by an extension 146 of the top drive 140. Extension 146 extends downwardly from the top drive threads 147 and is configured to fit within and extend out from a casing joint 114/coupling 116 which may be engaged to the top drive. Extension 146 includes a bore 170 through which drilling fluid can be pumped and a bottom end portion 148 sized and configured to fit within a landing portion 172 formed in valve body 126. Landing portion 172 is, in the illustrated embodiment, an enlarged portion of bore 128 and includes a bottom bearing 174, such as a bronze ring, against which portion 148 can bear. A radial bearing ring 176 is also provided to ease interface between the valve body and the extension. Seals 178 are housed in glands 180 to provide a seal between the valve body and the extension against fluid flow therethrough such that any fluid injected through bore 170 can be passed through the valve substantially without leaking out around extension 146.

A length 183 of extension 146 includes an outer diameter $OD_{183}$ sized to fit snugly between collet fingers 166 and that is slightly less than the diameter of the space between lugs 182 on the collet fingers so that the collet fingers are not free to bias inwardly while the extension passes therebehind.

However, extension 146 includes an annular groove 181 spaced from its lower end a space corresponding generally to the distance between lugs 182 and bottom bearing 174 so that the groove is positioned behind the lugs 182 when the extension is positioned against bearing 174 and is, therefore, fully inserted into landing portion 172. In this position, fingers 166 are free to be forced radially inwardly toward extension 146.

Referring also to FIGS. 8 to 11, it was noted hereinbefore that a valve retaining clamp 132 is useful for retaining valve device 110 in the drill string when the top drive extension is not bearing thereagainst. Valve retaining clamp 132 may include a lower return 134, which can be engaged under coupling 116, and an upper return 136. Upper return 136 is spaced relative to lower return 134 such that the upper return extends over the open upper end of the top coupling on drill string when the lower return is engaged under the coupling. Upper return 136 is sized to be abutted by valve body 126 to prevent it from passing therethrough. Return 136 defines an aperture 138 through which extension 146 can be inserted to engage valve device 110. As shown, the edges of return 136 about the aperture can be ramped, at 147, to facilitate insertion of the extension therethrough. In one embodiment, the diameter of aperture 138 can be selected to correspond with or be greater than bore 128 inner diameter at tube 171 so that the extension, during insertion, is substantially prevented from prematurely bumping the valve device, and thereby disengaging it from stepped portion 170.

Clamp 132, for ease of use, may be configured as shown. In particular, clamp 132 can include semicircular halves 184*a*, 184*b* pivotally connected at hinge 186 and releasably lockable at latch 188. Latch 188 can be spring biased to permit automatic locking when the halves are pivoted together. A lock pin 190 can be secured between alignable holes 191 on either side of the latch as a safety measure to prevent inadvertent unlatching. Handles 192 can be provided to facilitate handling.

Figure 12:
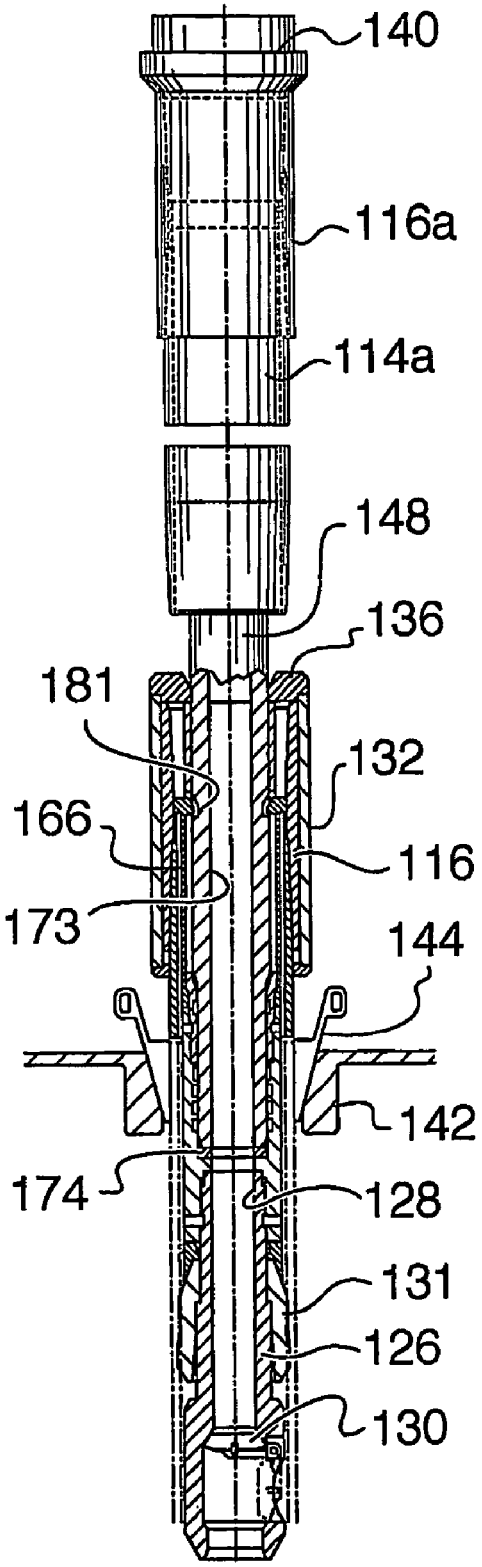
FIG. 12 is an axial sectional view of a gas valve assembly including a valve device inserted into the top end of a casing string that is secured into a drill floor by slips. Fingers at the top end of the valve device are hooked above a torque ring in the casing string. A stinger tip is fully engaged with the valve device and a valve-retaining clamp is attached to the top casing coupling.
Figure 13:
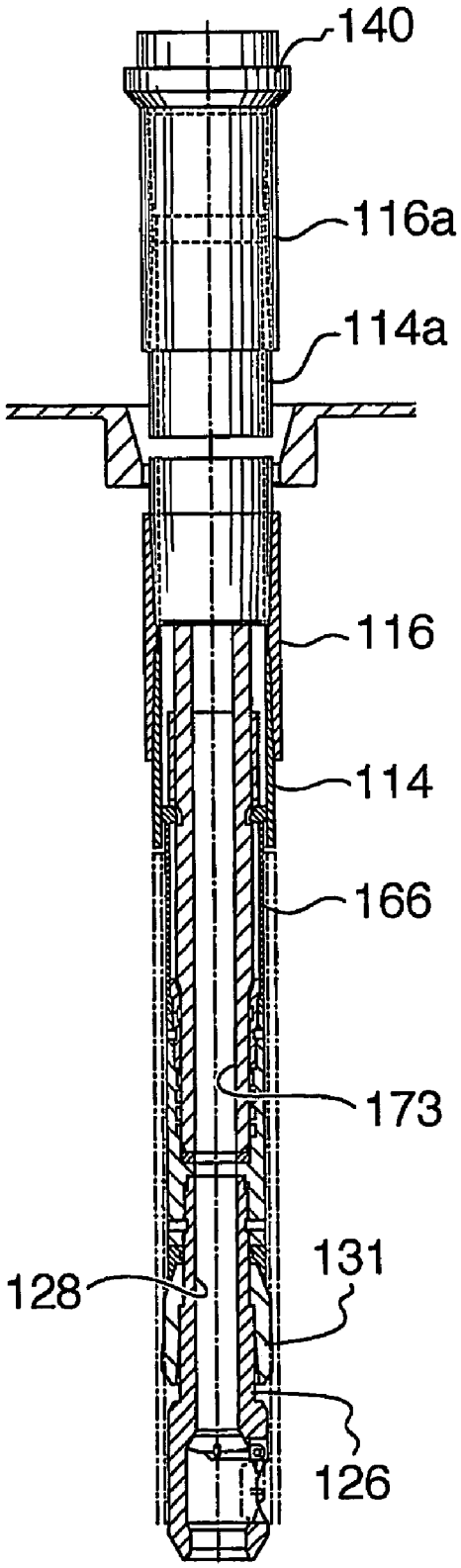
FIG. 13 is an axial sectional view of the completed joint with the slips removed and the drilling operation continuing.

In use and with reference to FIGS. 12 and 13, valve assembly 110 may be used to retain the pressure in a drill string, wherein for example compressed gas is used as a drilling fluid. In such an embodiment, the valve device 110 may be positioned in a drill string 112 adjacent the upper end thereof with lugs 168 of collet fingers 166 engaged against the stepped portion 170 as formed by torque ring or pin end face. When there exists or is generated a pressure differential between the drill string inner diameter and atmosphere, clamp 132 is secured over the open end of the drill string to prevent the valve device from being expelled therefrom.

The top drive 140 is used to engage casing joints, such as casing joint 114*a*, and bring them for connection into the drill string in which the valve device is engaged. As a casing joint is brought into alignment with the upper end of the drill string, extension 146 will pass into landing portion of the valve body and eventually engage against the bottom bearing 174. At this point, groove 181 may be positioned in line with lugs 182. Force can then be applied against the valve body by the extension to drive lugs 168 out of engagement with stepped portion 170, wherein the fingers 166 are forced inwardly. In this configuration, however, lugs 182 engage against stepped edges of groove 181 and the fingers are prevented from biasing out of engagement with the extension, as limited by abutment of lugs 168 against the inner wall of the drill string. This provides engagement between extension 146 and valve device 110 so that it is moved down as the top drive brings in casing joint 114*a* to be connected to coupling 116. At this point, clamp 132 must be removed to provide access to the threads of coupling 116. Since the extension is holding the valve, clamp 132 can be removed at this point even though there exists a pressure differential.

Drilling can now resume with drilling fluid being pumped through conduit 173, bore 128 and past flapper valve 130. When the whole connection at coupling 116 descends below the drill floor a new connection has to be made again. Top drive 140 can be disengaged and lifted from the top casing coupling 116*a*, thereby drawing the whole assembly of extension 146 and valve device 110 engaged thereto up through casing joint 114*a* toward coupling 116*a*.

In preparation for complete removal of top drive 140 and extension 146 and in order to ensure that valve device 110 remains in the top part of the casing string, a clamp 132 may again be fastened on the top casing coupling. When pulling up the extension with the valve device hooked thereon, upper end 126*a* of the device abuts against return 134. At this point, valve fingers 166 will be positioned above stepped portion 170 and free to open radially outwards. This permits disengagement of lugs 182 from groove 181 on the OD of the extension. At the same time, lugs 168 of the fingers can flex out to engage the stepped portion, as provided by the torque ring, the casing end face or the ID of the casing. As will be appreciated the distance between end 126*a* and lugs 168 should be less than the distance between the upper end of the drill string (or in any event the return 136 on clamp) and stepped portion 170 for engagement between lugs 168 and stepped portion 170 to be permitted. Valve device 110 is now secured in this uppermost position while extension is disengaged completely. Flapper valve 130 can be biased to close and compressed gas in the casing string is prevented from escaping due to the valve closure and seal 131. A new casing joint connection can be made on the top drive and extension inserted into the valve device. The whole process can be repeated without escape of the compressed gas.

Figure 5:
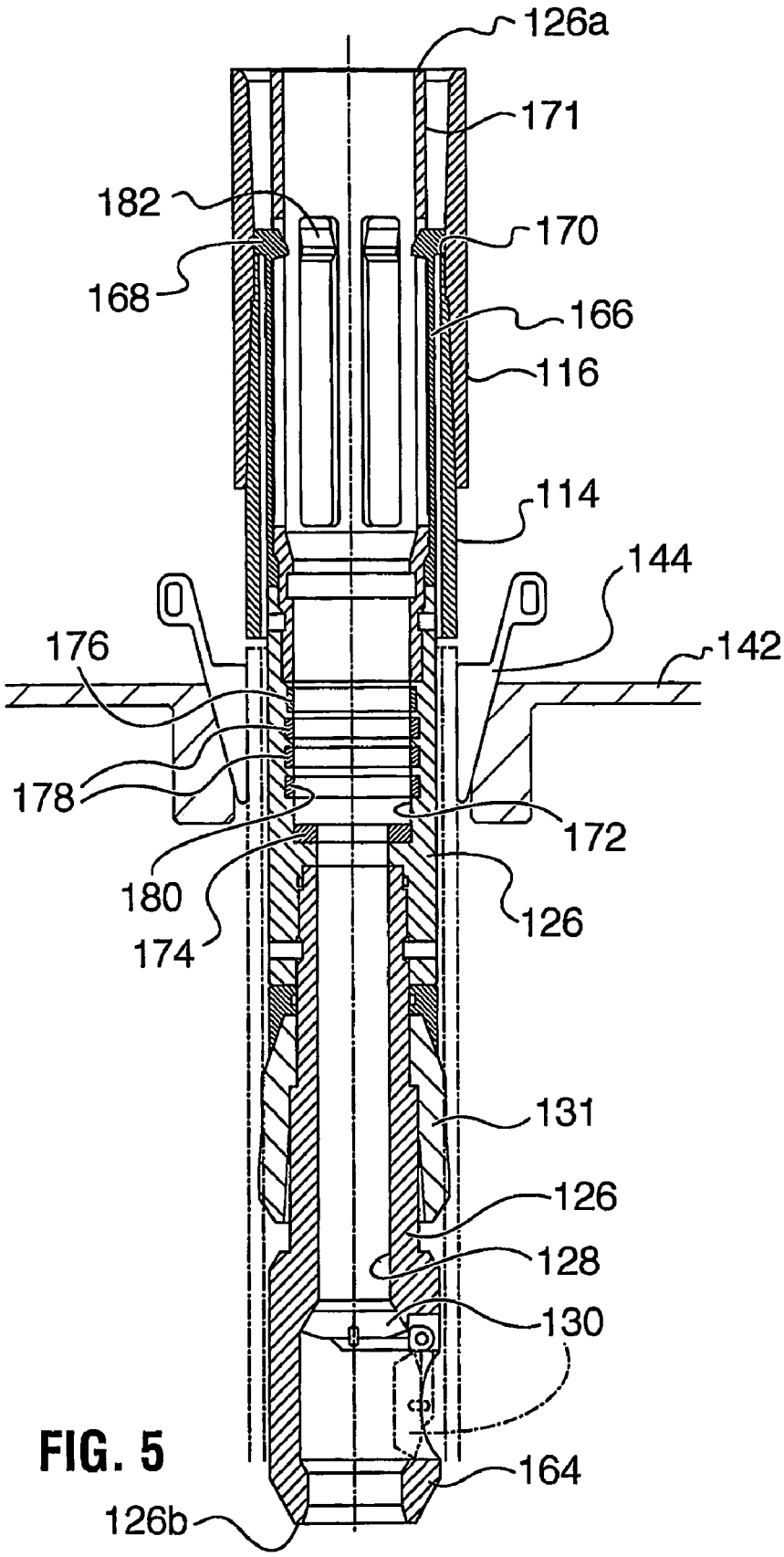
FIG. 5 is an axial sectional view of the valve device of FIG. 2A shown inserted into the top end of a casing drill string, which is secured by slips to the drill floor.
Figure 14:
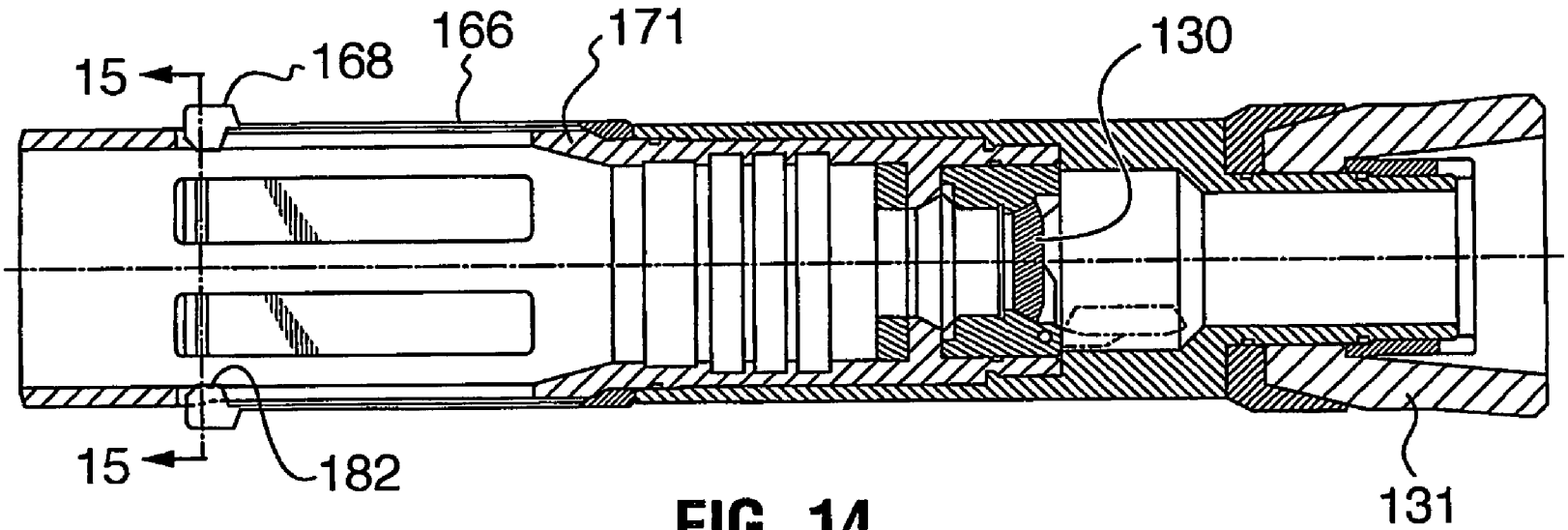
FIG. 14 is an axial sectional view of another valve device according to the present invention.
Figure 15:
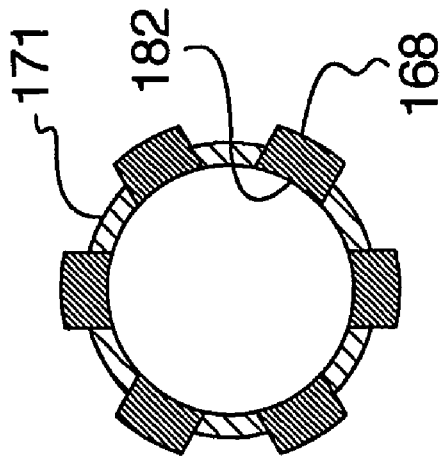
FIG. 15 is a section along line 15—15 of FIG. 14.

With reference to FIG. 14, another valve device 210 is shown which is intended for use in larger diameter drill strings that that device 110 of FIGS. 1 to 13. In particular, while device 210 is generally similar to device 110, flapper valve 230 can be positioned in a section of body 226 which permits the valve more room but does not affect operation thereof. Seal 131 may be moved down since opening 165, as shown in FIG. 5, about the flapper may not be provided.

While particular embodiments have been shown, they are not intended to be limiting but, rather, illustrative. The invention is to be defined by the attached claims.

We claim:

1. A method for drilling with a compressible drilling fluid, the method comprising: providing a drill string having an inner wall, an inner diameter and an upper end, positioning a valve into the drill string inner diameter to seal against fluid passage therepast except through the valve and the valve being selected to maintain fluid pressure in the drill string when the upper end of the drill string is open to atmosphere; repositioning the valve adjacent the upper end of the drill string each time a joint of pipe is added to the drill string while maintaining drilling fluid pressure inside the drill string.

2. The method of claim 1 wherein the step of repositioning includes providing a drill string axial and rotational drive mechanism to add pipe joints to the drill string and engaging the valve with the drill string axial and rotational drive mechanism when a new uppermost pipe joint is brought for connection to the drill string and drawing the valve up into the new uppermost pipe joint as the drive mechanism is withdrawn to pick up a subsequent pipe joint.

3. A valve for use with a drill string axial and rotational drive mechanism in a drilling operation, the valve comprising: a valve body insertable into a drill string inner diameter to seal against fluid passage past the body except through the valve and selected to maintain fluid pressure in the drill string when the upper end of the drill string is open to atmosphere and capable of being releasably engaged to the drive mechanism to be slidably moved within the drill string, as driven by the drive mechanism, but releasable from the drive mechanism, when the drive mechanism is removed from the drill string.

4. The valve of claim 3 wherein the valve body includes a bore therethrough from its upper end to its lower end; a seal about the valve body, to seal between the valve body and the drill string inner wall but permitting the valve to be positionable in and slidable through the drill string; a one-way valve in the bore permitting fluid flow through the bore from the upper end to the lower end but sealing against reverse flow therethrough: a portion for releasable engagement with the drive mechanism such that the valve is drivable by the drive mechanism through an upper portion of the drill string, but releasable therefrom to remain in the drill string when the drive mechanism is removed therefrom.

5. The valve of claim 4 wherein the one way valve includes a ball check valve.

6. The valve of claim 4 wherein the one way valve includes a flapper valve.

7. The valve of claim 4 wherein the seal about the valve body includes a packer seal element that will seal passage of compressed fluid between the inner diameter of the casing and the outside of the valve body.

8. The valve of claim 3 wherein the valve body includes a landing portion for accepting therein a portion of or an extension of the drive mechanism and releasably locking thereto such that the valve is moveable by the drive mechanism through an upper portion of the casing string.

9. The valve of claim 8 wherein the landing portion includes a bearing ring.

10. The valve of claim 8 wherein the landing portion includes a seal to provide sealing engagement between the drive mechanism and the valve body so that fluid can be injected from the drive mechanism into the bore of the valve body to pass through the one-way valve.

11. The valve of claim 3 further comprising a releasable drill string engaging means on the valve body that secures the valve body to the inner wall of the drill string such that it does not drop by gravity through the drill string.

12. A method for manipulating a drill string when using a drill string axial and rotational drive mechanism and a compressed fluid as the drilling fluid, the drill string having an inner wall and an upper end, and the method comprising: providing a valve insertable into a drill string inner diameter to seal against fluid passage therepast except through the valve and selected to maintain fluid pressure in the drill string when the upper end of the drill string is open to atmosphere and capable of being releasably engaged to the drive mechanism to be slidably moved within the drill string, as driven by the drive mechanism, but releasable from the drive mechanism, when the drive mechanism is removed from the drill string; positioning the valve in the drill string inner diameter adjacent an upper end thereof; engaging the valve with the drive mechanism to move therewith to be drawn adjacent the upper end of the drill string as pipe connections are made thereto; and injecting fluid as the drilling fluid to the drill string through the valve.

13. The method of claim 12 wherein the drill string is used to drill a borehole with the fluid as the drilling fluid and the valve can seal the compressed fluid within the drill string such that the fluid pressure need not be lost each time the upper end of the drill string is opened to atmosphere.

14. The method of claim 12 wherein the drill string is formed of casing.

15. The method of claim 12 wherein the drill string is formed of a string of interconnected liners.

16. The method of claim 12 wherein the manipulation can be during a drilling operation wherein a wellbore liner is used as the drill string.

17. The method of claim 12 wherein the drill string is formed of interconnected tubulars and the drive mechanism includes an extension extending therefrom a distance such that when the drive mechanism is engaged to a tubular to be attached to the drill string, the extension extends through and out from the end of the tubular.

18. The method of claim 17 wherein the extension engages the valve when the drive mechanism joint brings the tubular over the drill string.

19. The method of claim 12 further comprising providing a valve-retaining clamp for securing over the upper end of the drill sting to retain the valve in the drill string.

20. The method of claim 19 further comprising using the valve-retaining clamp as a guide to facilitate engagement between the drive mechanism and the valve.

21. A valve assembly for sealing a pressurized fluid within a drill string during drilling using a drill string axial and rotational drive mechanism and a compressed fluid as the drilling fluid, the drill string having an inner wall and an upper end and the valve assembly comprising: a valve body having a bore therethrough from its upper end to its lower end; a seal about the valve body, to seal between the valve body and the drill string inner wall but permitting the valve to be positionable in and slidable through the drill string; a one-way valve in the bore permitting fluid flow through the bore from the upper end to the lower end but sealing against reverse flow therethrough, and a portion for releasable engagement with the drive mechanism such that the valve is drivable by the drive mechanism through an upper portion of the drill string, but releasable therefrom to remain in the drill string when the drive mechanism is removed therefrom; and a valve-retaining clamp for securing over the upper end of the drill sting to retain the valve in the drill string when the drive mechanism is removed therefrom.

22. The valve assembly of claim 21 wherein the one way valve includes a ball check valve.

23. The valve assembly of claim 21 wherein the one way valve includes a flapper valve.

24. The valve assembly of claim 21 wherein the seal about the valve body includes a packer seal element that will seal passage of compressed fluid between the inner diameter of the casing and the outside of the valve body.

25. The valve assembly of claim 21 wherein the portion for releasable engagement includes a landing portion for accepting therein a portion of the drive mechanism.

26. The valve assembly of claim 25 wherein the landing portion includes a bearing ring.

27. The valve assembly of claim 25 wherein the landing portion includes a seal to provide sealing engagement between the drive mechanism and the valve body so that fluid can be injected from the drive mechanism into the bore of the valve body to pass through the one-way valve.

28. The valve assembly of claim 21 further comprising an extension attached to and extending from the drive mechanism for extension into the drill string to engage the valve body.

29. The valve assembly of claim 28 wherein the extension is selected to extend down from the drive mechanism a length longer than a tubular to be connected into the drill string and to extend out from a lower end of the joint of casing when the drive mechanism engages that tubular's upper end.

30. The valve assembly of claim 28 wherein the extension includes a bottom end of the extension formed to interact with the bore geometry of the valve body.

31. The valve assembly of claim 28 wherein the extension is formed as a conduit extending from and in communication with a drilling fluid conduit of the drive mechanism such that drilling fluid can be passed through the drive mechanism and into the extension for injection through the bore of the valve to the drill string.

32. The valve assembly of claim 21 wherein the valve device includes a releasable drill string engaging means that secures the valve body to the inner wall of the drill string such that it does not drop by gravity through the drill string.

33. The valve assembly of claim 21 wherein the drill string is a string of well bore casing and the releasable drill string engaging means includes a plurality of collet fingers engageable against the pin engaging face of the torque ring or the face of the casing pin end.

34. The valve assembly of claim 21 further comprising an extension attached to and extending from the drive mechanism for extension into the drill string to engage the valve body and wherein the valve device includes a releasable drill string engaging means that secures the valve body to the inner wall of the drill string such that it does not drop by gravity through the drill string, the releasable drill string engaging means being releasable from the drill string through manipulation by the extension and wherein the extension and releasable drill string engaging means are formed to releasably interengage when the releasable drill string engaging means drives the releasable drill string engaging means to be released from the drill string.

35. The valve assembly of claim 34 wherein the drill string is a string of well bore casing and the releasable drill string engaging means includes a plurality of collet fingers engageable against a shoulder selected from the pin engaging face of the torque ring or the face of the casing pin end and releasable from the shoulder by forcing the collet fingers axially against the shoulder.

36. The valve assembly of claim 35 wherein the extension includes a cylindrical outside surface sized to bear against the collet fingers to ensure their engagement against the shoulder as the extension is being inserted into the valve device.

37. The valve assembly of claim 36 wherein the extension includes an annular groove into which the fingers can collapse once the extension is fully inserted into the valve device.

38. The valve assembly of claim 35 wherein the fingers include inwardly directed lugs and the extension includes an annular groove into which the lugs are be driven to engage once the extension is fully inserted into the valve device so that the valve is carried on the drive mechanism extension.

* * * * *